US010813515B2

(12) United States Patent
Reccanello

(10) Patent No.: US 10,813,515 B2
(45) Date of Patent: Oct. 27, 2020

(54) SURFACE TREATMENT MACHINE WITH LEVEL CONTROL

(71) Applicant: IP CLEANING S.R.L., Portogruaro (VE) (IT)

(72) Inventor: Francesco Reccanello, Padua (IT)

(73) Assignee: IP CLEANING S.R.L., Portogruaro (IT)

( * ) Notice: Subject to any disclaimer, the term of this patent is extended or adjusted under 35 U.S.C. 154(b) by 470 days.

(21) Appl. No.: 15/756,392

(22) PCT Filed: Sep. 1, 2016

(86) PCT No.: PCT/IB2016/055243

§ 371 (c)(1),
(2) Date: Feb. 28, 2018

(87) PCT Pub. No.: WO2017/037653

PCT Pub. Date: Mar. 9, 2017

(65) Prior Publication Data

US 2018/0249876 A1 Sep. 6, 2018

(30) Foreign Application Priority Data

Sep. 2, 2015 (IT) ..... 102015000047889

(51) Int. Cl.
*A47L 11/30* (2006.01)
*A47L 11/40* (2006.01)

(52) U.S. Cl.
CPC ..... *A47L 11/30* (2013.01); *A47L 11/4008* (2013.01); *A47L 11/4011* (2013.01); *A47L 11/4083* (2013.01); *A47L 11/4088* (2013.01)

(58) Field of Classification Search
CPC ... A47L 11/30; A47L 11/4008; A47L 11/4011
See application file for complete search history.

(56) References Cited

FOREIGN PATENT DOCUMENTS

WO WO 2010/100796 A1 9/2010

OTHER PUBLICATIONS

International Search dated Feb. 7, 2018, issued to International Application No. PCT/IB2016/055243.

*Primary Examiner* — Andrew A Horton
(74) *Attorney, Agent, or Firm* — Stein IP, LLC

(57) ABSTRACT

A surface treatment machine, comprising a frame configured to translate with respect to a surface to treat, a surface treatment element connected to said frame and configured to treat with liquid a surface, a reservoir connected to the frame arranged to provide liquid to the surface treatment element through a delivery mouth; an adjustment element arranged to feed adjustably the liquid supplied from the reservoir to the delivery mouth. It is then provided a sensor adapted to measure the level of residual liquid in the reservoir. A control unit receives from the sensor a signal proportional to residual liquid in the reservoir for adjusting the adjustment element responsive to this value, in order to deliver the liquid with optimization of the flow-rate responsive to a liquid saving parameter. It is possible then to maximize the range of the machine, and to optimize the working time of the operator.

6 Claims, 4 Drawing Sheets

SURFACE TREATMENT MACHINE WITH LEVEL CONTROL

CROSS-REFERENCE TO RELATED APPLICATIONS

This application is a national stage of International Application No. PCT/IB2016/055243, filed Sep. 1, 2016, which claims the benefit of priority to Italian Application No. 102015000047889, filed Sep. 2, 2015, in the Italian Patent Office, the disclosures of which are incorporated herein in their entireties by reference.

FIELD OF THE INVENTION

The present invention relates to surface treatment machines of the type having a surface treatment element configured to treat a surface with liquid.

Among such machines there are comprised both those of ride-on type and of walk-behind type, which can be either motorized or pushed, with a surface treatment element in the form of either a brush, disc, pad, spraying member.

DESCRIPTION OF THE PRIOR ART

Machines exist for treating surfaces with liquid that provide the application of the liquid by means of a treatment element, taking the liquid from a reservoir on board of the machine.

Once ended the liquid, the operator has to bring normally the machine to a point of replenishment, for filling again the reservoir.

In some cases the dirty liquid is collected from the surface by the same machine, for example by a suction system, which is arranged to drain the liquid by suction up to a collection container on board of the machine. When the reservoir is emptied also the collection container is normally full, because the latter is sized according to the capacity of the reservoir.

The operators of such surface treatment machines, in case they have to cover wide surfaces, like the case for example of overnight cleaning of places like airports, hospitals, schools, offices, etc., have often the problem of not knowing, unless in very rough approximation, the amount of residual liquid in the reservoir, and then the range of the machine in terms of amount of surface that can be treated before making again a replenishment of liquid.

A precise knowledge of the range of the machine is desirable, because it would allow planning an optimal treatment route, up to the nearest replenishment point, before the treatment liquid ends.

In WO2010/099968A2 a machine for cleaning surfaces is described that provides a system for automatically calculating the range of the machine. It carries out a measurement of physical and kinematical quantities, in particular the speed of the machine, from which the ratio is calculated between the cleaned surface and the time necessary to clean it, responsive to many parameters indicated by the operator, like the size of the brush or the size of the nozzle for soaking the brush. The operator, by knowing the residual range of the machine, has a useful information for completing the route up to the next replenishment.

In the surface treatment machines with liquid treatment, it can occur that the delivery of liquid to the surface treatment element is not constant, and this does not allow to calculate precisely the range of the machine, with an easy knowledge of physical and kinematical quantities, as space, time, speed.

For example, in case of feeding the liquid by gravity, as the reservoir is progressively emptied the flow-rate of liquid to the treatment element changes. Apart from the case of feeding the liquid by means of a positive displacement pump, which however would be heavier and expensive, with other types of pumps the flow-rate of liquid to the surface treatment element can change, owing to leakages and to sensitivity of the pump at the supply pressure. The operator, then, in order ensure an effective treatment, i.e. with a sufficient amount of liquid versus treated surface, adjusts the opening value of the feeding duct section in such a way to ensure always an amount of liquid vis-a-vis treated surface that is enough for treatment, even in the most unfavorable situations. This determines, however, owing to unsteadiness of the flow-rate, a reduction of the range of the machine.

Furthermore, changing the speed of the surface treatment machines with respect to the surface to treat, there is a subsequent change of the amount of supplied liquid versus treated surface, and also this requires an adjustment of the feeding duct section, in order to ensure an amount of liquid that is sufficient also in case of maximum speed of the machine, with the consequence of reducing the range of the machine.

In U.S. Pat. No. 8,551,262 a chemical detergent is dosed with respect to water, taking into account the level in the water reservoir. A level sensor provides a signal of level that influences a controller of a positive displacement pump which feeds the chemical detergent. This way, the dilution in water of the chemical detergent is kept fixed regardless of the level of water in the reservoir. In WO2010/110796 a surface treatment machine is described having a reservoir containing a cleaning solution, which reaches a point of delivery through a duct under the control of a flow control module. A pump controls the flow of a chemical substance supplied to the line of fluid flow. A controller controls the flow control module for working at an operative flow-rate based on a level in the cleaning solution detected by a solution sensor. The controller controls the chemical pump for working at a flow-rate according to operative flow-rate so that the chemical substance is supplied to the point of delivery to a selected chemical dilution ratio. Such document teaches to provide a predetermined concentration of chemical substance in the washing liquid, but it does not determine of the residual range of the machine.

SUMMARY OF THE INVENTION

It is a feature of the present invention to provide a surface treatment machine that ensures an effective treatment concerning the amount of liquid versus treated surface and in the meantime maximizes the range of the machine.

It is another feature of the invention to provide such a machine which permits controlling the delivery of liquid to the surface treatment element versus the level of liquid present in the reservoir for improving the range of the machine.

It is another feature of the invention to provide such a machine for maximizing the range of the machine responsive to a predetermined cleaning route to be followed.

It is also a feature of the present invention to provide such a machine that enables an operator to determine in real time the residual range of the machine.

These and other objects are achieved by a surface treatment machine, comprising:

a frame configured to translate with respect to a surface to treat, a surface treatment element connected to the frame and configured to treat with liquid a surface with respect to which the frame advances, a reservoir connected to the frame and arranged to supply a liquid to the surface treatment element through a delivery mouth;

an adjustment element arranged to feed adjustably the liquid supplied from the reservoir to the delivery mouth;

a sensor configured to measure the level of residual liquid in the reservoir and to provide a measurement signal;

an input/output unit configured to display said measurement signal indicating the residual level of liquid and for entering a liquid saving parameter;

a control unit configured to receive said measurement signal from the sensor and said liquid saving parameter;

a program means, resident in said control unit and configured to set the adjustment element responsive to said measurement signal and to said liquid saving parameter, wherein the input/output unit is associated with a display unit of the operating parameters and of a value of range of the machine calculated on the basis of instant values of the measurement of the level of residual liquid present in the reservoir and of the selected liquid saving parameter.

This way, the operator can, according to the residual level, to set the residual range of the machine concerning for example the residual surface to treat or the treatment distance to be covered up to the next replenishment, so that the adjustment element provides a constant value of treatment liquid for all the treatment according to the selected liquid saving parameter.

Furthermore, the operator is enabled to see on the display unit the values of residual range of the machine, versus time, or the residual surface to treat, in order to determine the optimal route that allows to reach a replenishment point without loss of time or covering useless routes. In case, during the route, the operator selects to change the liquid saving parameter, this can be done, changing, thus constant value of carried of treatment liquid dispensed The machine can then deliver a constant amount of liquid taking into account both the liquid saving parameter selected by the operator for reaching the closest replenishment point, and the residual liquid present in the reservoir, since it influences the amount of liquid supplied responsively to the different head of the residual liquid at the at an outlet section of the reservoir, avoiding the undesirable effect of delivery affected by the level of liquid in the reservoir, optimizing the flow-rate, achieving the goal of maximizing the range of the machine responsive to the remaining space to be treated up to reaching a programmed replenishment point.

The liquid saving parameter can be indicated concerning volume of liquid versus treated surface, and can be for example positive, zero or negative, indicating if the machine must deliver more or less liquid with respect to a reference preset adjustment value. In this case, the control unit recalculates the residual range of the machine and the input/output unit displays such residual range of the machine, for verification by the operator. While continuing with the treatment, the residual range of the machine can be continuously updated and displayed to the operator. The liquid saving parameter can be expressed also directly as value of residual range of the machine that the operator wishes to achieve.

Advantageously, said measurement signal proportional to the amount of liquid present in the reservoir can be a pressure value and the sensor is a sensor of pressure arranged in communication with the reservoir for determining the level of liquid present in the reservoir.

This solution allows a very precise control of the liquid level in the reservoir. In fact, a pressure sensor located at the base of the reservoir, after filtering away any fluctuations due to the movement of the machine that are eliminable as noise, gives a precise value of the level, which can influence the flow-rate, i.e. the hydrostatic pressure, owing to the liquid head in the reservoir, in order to optimize the flow-rate.

Alternatively, the level of liquid present in the reservoir can be determined with a force sensor, in particular a load cell, which can be arranged to hold the weight of support elements of said reservoir.

Alternatively, the level of liquid present in the reservoir can be determined with a level sensor, in particular an optical sensor or ultrasonic pulse sensor or floating sensor, which can be arranged in said reservoir, and configured to measure the distance of the liquid surface from a bottom or from a top wall of the reservoir.

In a possible exemplary embodiment, the adjustment element is selected from the group consisting of:

a piloted valve, where the control unit is configured to adjust an opening section of the valve in an increasing way responsive to decrease of the level or in a decreasing way responsive to increase of the flow-rate saving selected by the operator;

a pump, where the control unit is configured to adjust the speed of the pump in an increasing way responsive to decrease of the level or in a decreasing way responsive to increase of the flow-rate saving selected by the operator.

This way, there is an elimination of the undesirable effect that causes the variation of the flow-rate of liquid supplied to the surface treatment element versus the level of liquid present in the reservoir, and there is an optimization of the flow-rate according to the liquid saving parameter selected by the operator for reaching the closest replenishment point without stopping the treatment.

This adjusts the amount of liquid supplied, in order to have an ideal treatment efficiency without excessive or insufficient liquid supply, in order to maximize the range of the machine.

If the adjustment element consists of a piloted valve, the reservoir is arranged with respect to the delivery mouth for delivering liquid to the surface treatment element by gravity through the valve.

This solution makes it possible to minimize the costs for making the machine, since it does not need a pump for delivering the liquid to the treatment element, but exploits simply the gravity, achieving the goal of avoiding the difficulty to control the amount of supplied liquid responsive to the treated surface.

Then, the operator is enabled to see on the display unit the values of residual range of the machine, versus time, or the residual surface to treat, and to set in turn the treatment route that allows maximizing the range of the machine and eventually making a replenishment without loss of time or covering useless routes.

BRIEF DESCRIPTION OF THE DRAWINGS

The invention will be now shown with the following description of an exemplary embodiment thereof, exemplifying but not limitative, with reference to the attached drawings in which.

DETAILED DESCRIPTION OF SOME EXEMPLARY EMBODIMENTS

Figure 1:
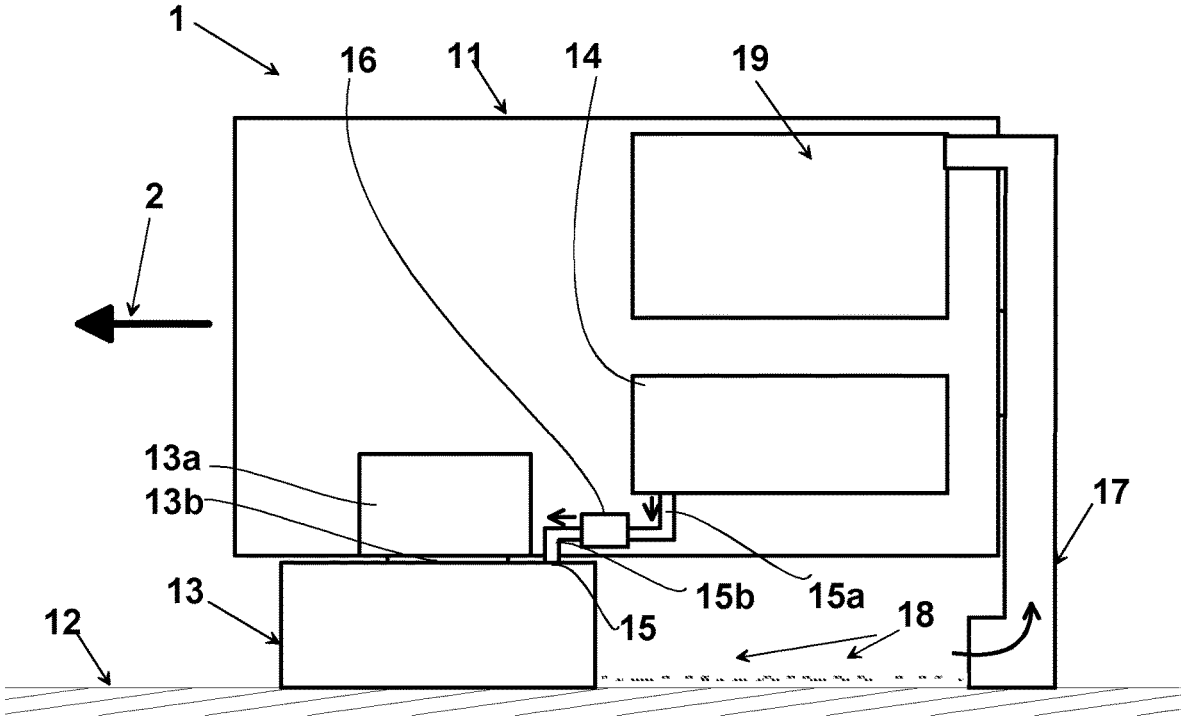
Fig. 1 (prior art)
FIG. 1 shows a block diagram of a generic surface treatment machine according to the prior art.

As shown in FIG. 1, a surface treatment machine, whose general layout is known and indicated as 1, comprises a frame 11 configured to translate with respect to a surface 12 to treat.

The translation, in the direction of arrow 2, can be carried out by pushing, through a handlebar or through separate handles (not shown), or in a motorized way, through wheels or tracks (not shown), and the machine can be of ride-on type or of walk-behind type. The surface 12 to treat can be a floor but it can also be vertical, such as the case of windows or vertical walls, with the machine moved on vertical guides or through lifting platforms (not shown).

Machine 1 comprises a surface treatment element 13, which is connected to the frame 11 and configured to treat with liquid surface 12, with respect to which the frame 11 advances.

The surface treatment element, indicated generally as block 13, can be a rotating brush or other brush element, as well as it can be a vibrating pad or other treatment element, for example a spray liquid distributor. A motor can be provided or other actuating element 13*a* for actuating a connecting element 13*b* linked to the surface treatment element 13, for example a rotating shaft.

Furthermore, machine 1 comprises a reservoir 14 connected to the frame 11 and arranged to supply a liquid to surface treatment element 13 through a delivery mouth 15. It is then provided an adjustment element 16 arranged to feed adjustably the liquid supplied from reservoir 14 to delivery mouth 15, and located between two branches 15*a* and 15*b* arranged for feeding the liquid from reservoir 14 to delivery mouth 15.

The treatment liquid in reservoir 14 can be water, water with detergent, pure detergent, or other treatment liquid, for example protecting film, coating film, etc. A further reservoir can also be provided which can contain a detergent to mix with the water before the delivery (not shown).

The adjustment element indicated generally with block 16 can be a valve or a pump. It can be simply an On/Off device or an adjustable device, for example an adjustable tap valve.

In FIG. 1 a collection element 17 is also shown, for example a squegee associated with a suction device, which is arranged to drain, as machine 1 progressively moves in the direction of arrow 2, the surplus treatment liquid 18 that soaks surface 12. Collection element 17 is connected hydraulically to a container 19 arranged for collecting residual liquid and possible dirt.

Collection element 17 can also be missing in certain models of machine.

In the rear zone of the machine wheels can be provided, not shown, driven or idle, both in the presence of collection element and without it.

Figure 2:
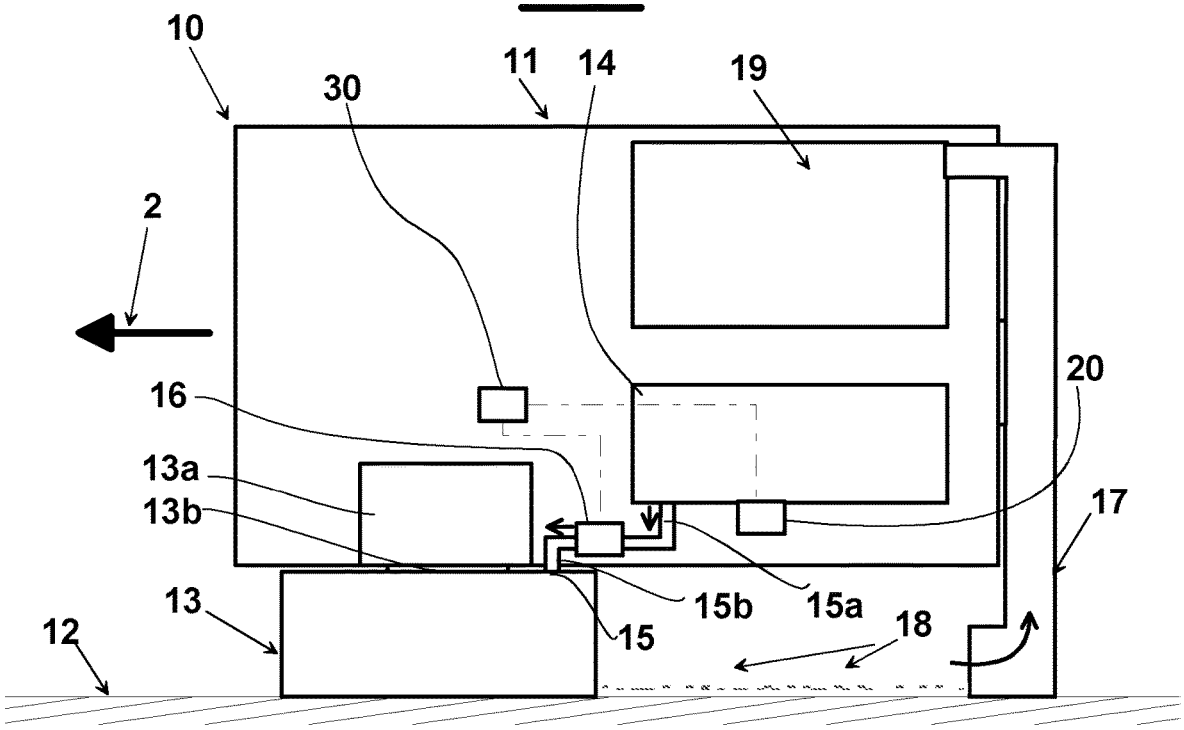
FIG. 2 shows a block diagram of a generic surface treatment machine according to the invention.

As shown in FIG. 2, according to the present invention, a surface treatment machine 10, starting from surface treatment machine 1 of FIG. 1, is modified in order to comprise an adjustment element 16 arranged to feed adjustably the liquid supplied by reservoir 14 to the delivery mouth. The adjustment element 16 can be, for example, an adjustment valve electrically, or an electric pump with adjustable speed.

Furthermore, it comprises a sensor 20 configured to measure the level of residual liquid in reservoir 14. Furthermore, it comprises a control unit 30 arranged to receive from sensor 20 a signal proportional to a level value and configured to set the adjustment element 16 responsive to a measured level value.

Sensor 20 can be a pressure sensor, arranged to provide a signal of pressure, communicating with a lower portion of reservoir 14. Such pressure sensor 20 is a sensor of the hydrostatic pressure directly related to the level of liquid surface 14*a*.

In this case, the adjustment element 16 is selected from the group consisting of:

- a piloted valve, where control unit 30 is configured to adjust an opening section of the valve in an increasing way responsive to decrease of the pressure;
- a pump, where control unit 30 is configured to adjust the speed of the pump in an increasing way responsive to decrease of the pressure.

In the control unit, for example, a table of values can be recorded that associates to each pressure, progressively decreasing, an adjustment parameter, for example an opening parameter, progressively increasing, of the piloted valve, or a number of turns, progressively increasing, of the pump. Or an algorithm can be provided for computing the adjustment parameter responsive to the pressure.

The measurement of the level is directly related to the volume of residual liquid, responsive to the geometry of the reservoir. This allows also to calculate the volume of residual liquid and then the range of the machine, versus the volume. Such volume value can be, advantageously, displayed on the machine, as useful information for operator.

Alternatively, sensor 20 is a force sensor, for example a load cell, for example located under reservoir 14, or arranged to hold the weight of support elements of reservoir 14, capable of measuring instantly the weight of the reservoir, which changes from a value of weight equal to reservoir 14 full to a value of weight equal to reservoir 14 empty. The weight of the residual liquid is easily related both to the amount of residual liquid, useful as value of range of the machine, and to the level, for determining the adjustment parameter.

As further alternative embodiment, sensor 20 can be, in a way not shown, a level sensor, for example an optical sensor, ultrasonic pulse sensor, electromagnetic, mechanical floating sensor located above or in the reservoir, and that is configured to measure the distance of the liquid surface 14*a* of the liquid from the upper wall of reservoir 14.

Also in the latter two cases, responsive to a decrease of the weight of the reservoir or the liquid level surface 14*a*, an adjustment parameter can be determined of the valve or the pump, for each flow-rate value of the liquid that can be supplied.

According to a further exemplary embodiment, not shown in the figures, control unit 30 can be associated with a display unit of a value of range of the machine calculated on the basis of instant values of the value determined by the sensor.

The adjustment element 16 can be a valve, for example a piloted valve, and reservoir 14 can be arranged, with respect to delivery mouth 15, for delivering liquid to surface treatment element 13 by gravity through the adjustment valve 16. In this case, the measurement of the level is essential to ensure an amount of liquid supplied that is constant, since the feeding by gravity is extremely affected by any variations of level in the water reservoir.

In particular, the operator can set a value of range of the machine so that up to the next replenishment the flow-rate of liquid is constant and all the liquid present in the reservoir is used.

Figure 3:
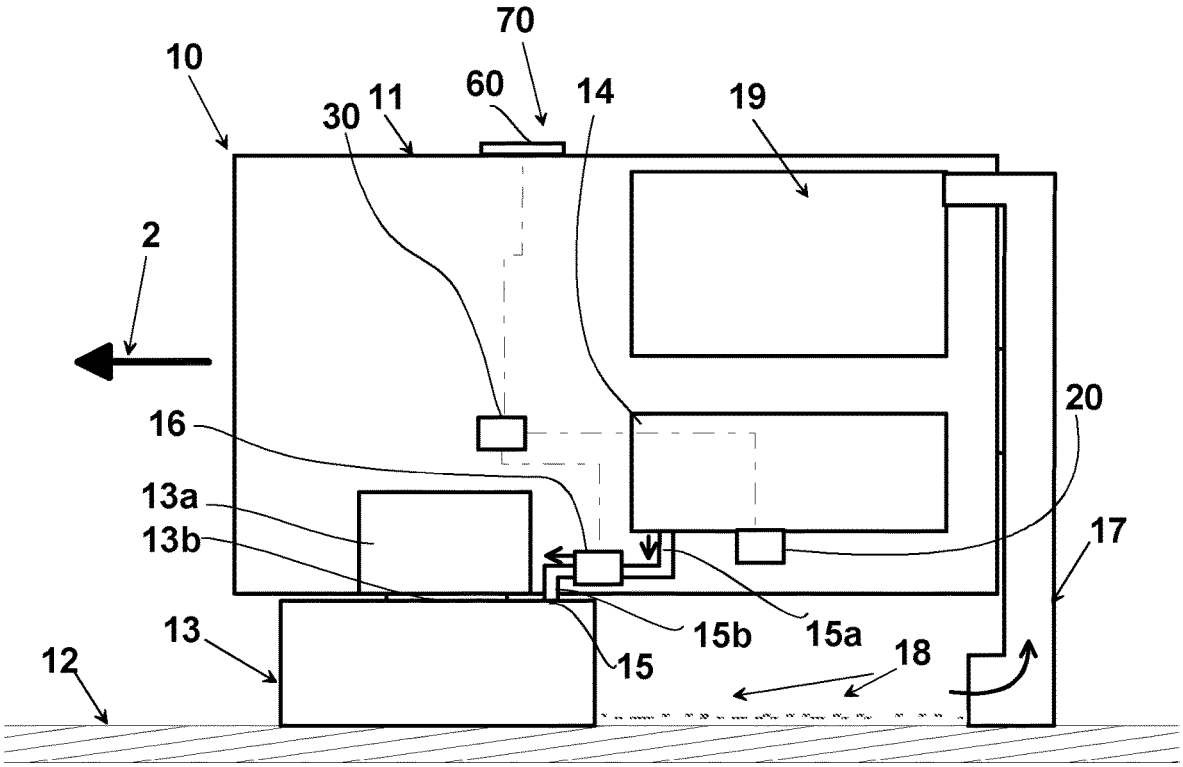
FIG. 3 shows an exemplary embodiment of the surface treatment machine of FIG. 2, with the addition of a input/output unit, with possible display unit.

In order to achieve this goal, as shown in FIG. 3, surface treatment machine 10 can present, in a preferred exemplary embodiment, an input/output unit 70, connected to control unit 30, and comprising a display unit 60 arranged to display the measurement signal computed on the basis of a signal coming from sensor 20, indicating the residual level of liquid and the residual range of the machine.

By input/output unit 70, a liquid saving parameter can be entered, which can be communicated to the control unit with the level measurement signal.

In control unit 30 a program means can be present that can control the adjustment element 16, for example a solenoid valve or pump, in the form of changing to the PWM, in function both of the measurement signal and of the liquid saving parameter.

Then, the operator can, according to the residual level determined by sensor 20, to set the residual range of the machine, by input/output unit 70, concerning for example the residual surface to treat (for example square meters) or distance (for example linear meters) which still remain to be covered up to the next replenishment.

To adjustment element 16, then, control unit 30 can provide a constant value of treatment liquid for all the treatment according to the selected liquid saving parameter.

Figure 4:
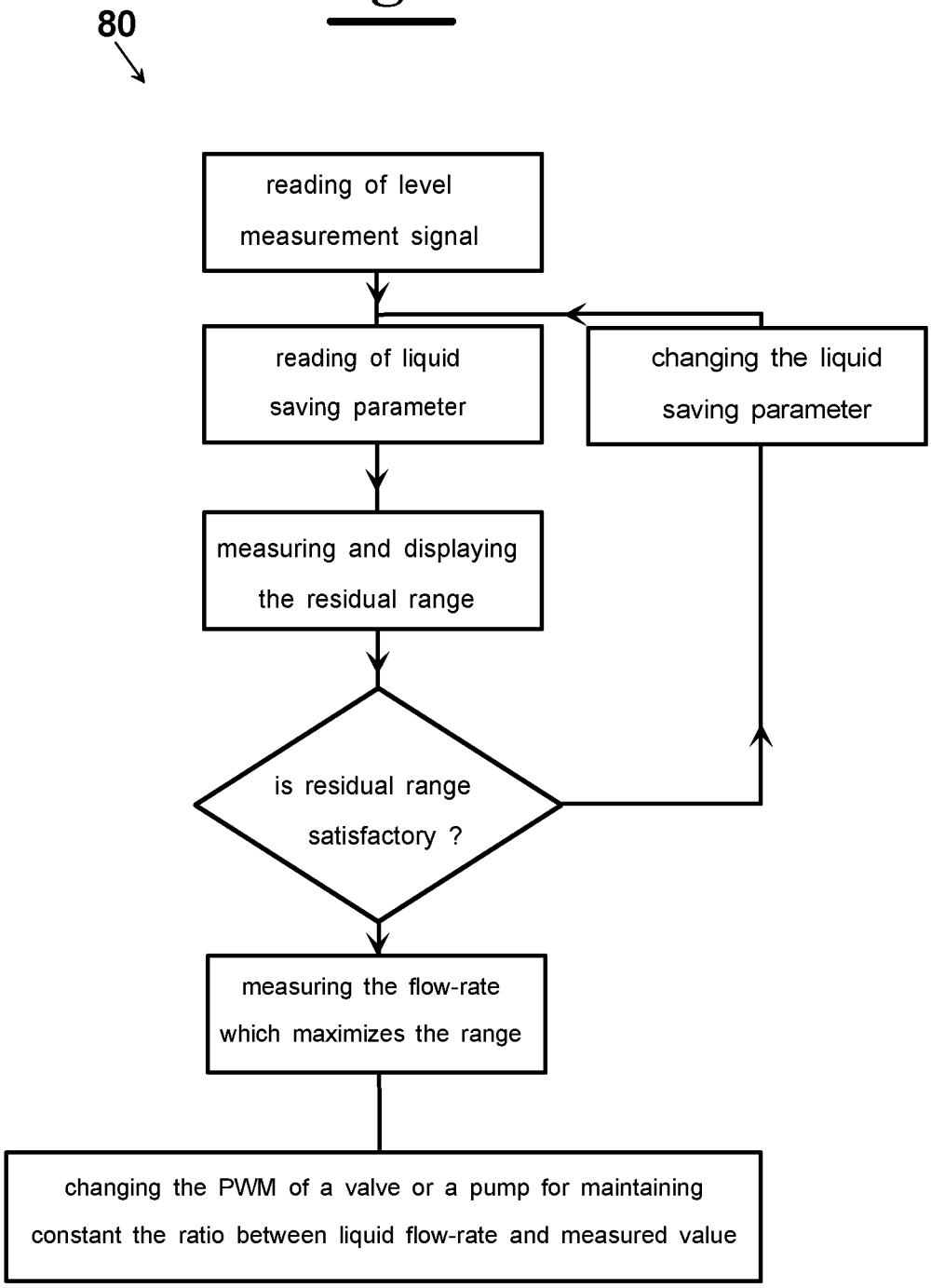
FIG. 4 shows a possible flow-sheet of the program means resident in the control unit of the machine.

A possible flow diagram followed by the program means, in particular a microprocessor, resident in unit 30 is given as an example in FIG. 4 (indicated as 80).

Machine 10, can then deliver a constant amount of liquid taking into account both the liquid saving parameter entered by the operator through the unit 70 for reaching the closest replenishment point, and the residual liquid present in reservoir 14, since it influences the amount of liquid supplied responsively to the different head of the residual liquid on the adjustment element 16, at an outlet section of the reservoir, avoiding the undesirable effect of delivery affected by the level of liquid in reservoir 14, optimizing the flow-rate, and achieving the goal of maximizing the range of the machine responsive to the remaining space to be treated up to reaching a programmed replenishment point.

The liquid saving parameter can be indicated concerning volume of liquid versus treated surface that can be delivered at mouth 15, and can be for example positive, zero or negative, indicating if machine 10 must deliver more or less liquid with respect to a reference preset adjustment value. In this case, control unit 30 recalculates the residual range of the machine and input/output unit 70 displays such residual range of the machine, for verification by the operator. While continuing with the treatment, the residual range of the machine can be continuously updated and displayed to the operator on unit 70. The liquid saving parameter can be expressed also directly as value of residual range of the machine that the operator wishes to achieve.

The foregoing description of specific exemplary embodiments will so fully reveal the invention according to the conceptual point of view, so that others, by applying current knowledge, will be able to modify and/or adapt in various applications the specific exemplary embodiments without further research and without parting from the invention, and, accordingly, it is meant that such adaptations and modifications will have to be considered as equivalent to the specific embodiments. The means and the materials to realize the different functions described herein could have a different nature without, for this reason, departing from the field of the invention. It is to be understood that the phraseology or terminology that is employed herein is for the purpose of description and not of limitation.

The invention claimed is:

1. A surface treatment machine, comprising:

a frame configured to translate with respect to a surface to treat, a surface treatment element connected to said frame and configured to treat with liquid a surface with respect to which said frame advances, a reservoir connected to said frame and arranged to supply a liquid to said surface treatment element through a delivery mouth;

an adjustment element arranged to feed adjustably the liquid provided by said reservoir to said delivery mouth;

a sensor configured to measure the level of residual liquid in the reservoir and to provide a measurement signal;

an input/output unit for display said measurement signal indicating the residual level of liquid in the reservoir and for entering a liquid saving parameter;

a control unit arranged to receive from said sensor said measurement signal and said liquid saving parameter;

a program means, resident in said control unit, configured to set the adjustment element responsive to said measurement signal and to said liquid saving parameter;

wherein said input/output unit comprises a display unit of said level measurement signal, of said liquid saving parameter, and of a calculated value of range of the machine.

2. Surface treatment machine according to claim 1, wherein said sensor is selected from the group consisting of:

a pressure sensor communicating with said reservoir and arranged to provide a signal of pressure owing to a liquid head starting from the liquid surface of said reservoir;

a force sensor, which can be arranged to hold the weight of support elements of said reservoir;

a level sensor, which can be arranged in said reservoir, and configured to measure the distance of the liquid surface from a bottom or from a top wall of said reservoir.

3. Surface treatment machine according to claim 2, wherein said adjustment element is selected from the group consisting of:

a piloted valve, wherein said control unit is configured to adjust the opening said valve in an increasing way responsive to decrease of the level of liquid in said reservoir;

an adjustable pump, wherein said control unit is configured to adjust the speed of said pump in an increasing way responsive to decrease of the level of liquid in said reservoir.

4. Surface treatment machine according to claim 2, wherein the force sensor is a load cell.

5. Surface treatment machine according to claim 2, wherein the level sensor is selected from the group consisting of: an optical sensor, an ultrasonic pulse sensor, a floating sensor.

6. A method of treatment of surfaces, comprising the steps of:

translating a surface treatment machine with respect to a surface to treat, said machine having a surface treatment element connected to a frame;

feeding, at said surface treatment element, a treatment liquid, so that said surface treatment element treats with said liquid said surface during said translating;

said treatment liquid being drawn from a reservoir connected to said frame, in order to provide said liquid to said surface treatment element through a delivery mouth;

adjusting said delivery of liquid provided by said reservoir to said delivery mouth;

said method characterized in that it comprises furthermore:

measuring by a sensor a level measurement signal of residual liquid in the reservoir, introduction of a liquid saving parameter related to the flow-rate of the liquid;

wherein said adjusting is carried out on the basis of a signal proportional to said level measurement signal and to said liquid saving parameter for delivering said liquid, in order to have an optimization of the flow-rate.

* * * * *